US010774647B2

(12) United States Patent
Kemp et al.

(10) Patent No.: US 10,774,647 B2
(45) Date of Patent: Sep. 15, 2020

(54) ROTOR WITH SLIDING VANE HAS A DIFFERENT WIDTH OF VANE SLOT EXTENDED FROM THE LONGITUDINAL AXIS TO THE OUTER SURFACE OF THE ROTOR BODY

(71) Applicant: Torad Engineering LLC, Cumming, GA (US)

(72) Inventors: Gregory T. Kemp, Alpharetta, GA (US); John Montgomery, Lilburn, GA (US); Joseph Orosz, Woodstock, GA (US)

(73) Assignee: Torad Engineering LLC, Cumming, GA (US)

( * ) Notice: Subject to any disclaimer, the term of this patent is extended or adjusted under 35 U.S.C. 154(b) by 273 days.

(21) Appl. No.: 16/008,072

(22) Filed: Jun. 14, 2018

(65) Prior Publication Data

US 2018/0371912 A1 Dec. 27, 2018

Related U.S. Application Data

(60) Provisional application No. 62/525,252, filed on Jun. 27, 2017.

(51) Int. Cl.
*F01C 1/00* (2006.01)
*F03C 2/00* (2006.01)
(Continued)

(52) U.S. Cl.
CPC ..... *F01C 21/0809* (2013.01); *B22D 19/04* (2013.01); *F01C 1/344* (2013.01);
(Continued)

(58) Field of Classification Search
CPC ..... F04C 2/344; F04C 2/3441; F04C 2/356; F04C 2230/10; F04C 2230/21; F04C 2240/20; F04C 2250/20; F01C 1/344; F01C 21/08; F01C 21/0809; F01C 21/0881; B22D 19/04; B22D 15/02; B22F 5/02; Y10T 29/49236; Y10T 29/49245
(Continued)

(56) References Cited

U.S. PATENT DOCUMENTS 1,252,841 A 1/1918 Reed
1,339,347 A * 5/1920 Jackson ..... F01C 21/0881 418/255
(Continued)

FOREIGN PATENT DOCUMENTS

DE 4407688 9/1995
DE 19703499 A1 * 8/1998 ..... F01C 21/08
(Continued)

*Primary Examiner* — Theresa Trieu
(74) *Attorney, Agent, or Firm* — Ballard Spahr LLP

(57) ABSTRACT

A method of casting a rotor using a cavity and core mold allows a longitudinal slot oriented transversely to the axis of rotation to be finish ground to high precision and tight tolerances by casting the slot to have a wider section which extends from the axis to a radius greater than the radii of the hubs of the rotor, and a narrower section which extends from the wider section to the outer surface of the rotor. The geometrical relation of the slot sections to the hubs as cast permits the grinding step to be performed without forming a leak path in either of the hubs.

13 Claims, 5 Drawing Sheets

(51) Int. Cl.

| | |
|---|---|
| ***F03C 4/00*** | (2006.01) |
| ***F04C 18/00*** | (2006.01) |
| ***F01C 21/08*** | (2006.01) |
| ***F01C 1/344*** | (2006.01) |
| ***F04C 2/356*** | (2006.01) |
| ***B22D 19/04*** | (2006.01) |
| ***F04C 2/344*** | (2006.01) |

(52) U.S. Cl.
CPC ..... *F01C 21/08* (2013.01); *F04C 2/344* (2013.01); *F04C 2/356* (2013.01); *F04C 2230/10* (2013.01); *F04C 2230/21* (2013.01); *F04C 2240/20* (2013.01); *F04C 2250/20* (2013.01)

(58) Field of Classification Search
USPC ..... 418/1, 253, 255, 259–260, 266–268; 29/888.02, 888.025, 888.072, 888.075
See application file for complete search history.

(56) References Cited

U.S. PATENT DOCUMENTS

| | | | | |
|---|---|---|---|---|
| 4,392,795 | A | 7/1983 | Smith | |
| 4,604,041 | A * | 8/1986 | Hertell | F01C 21/0863 418/268 |
| 5,409,360 | A * | 4/1995 | Wycliffe | F01C 21/0809 418/258 |
| 7,134,855 | B2 * | 11/2006 | Bohr | F01C 21/08 418/259 |
| 2010/0028189 | A1 * | 2/2010 | Cadeddu | F01C 21/0881 418/255 |

FOREIGN PATENT DOCUMENTS

| | | | | |
|---|---|---|---|---|
| DE | 102008054240 | | 7/2009 | |
| DE | 102013204504 | | 7/2014 | |
| EP | 3034779 | A1 * | 6/2016 | F01C 21/08 |

* cited by examiner

ROTOR WITH SLIDING VANE HAS A DIFFERENT WIDTH OF VANE SLOT EXTENDED FROM THE LONGITUDINAL AXIS TO THE OUTER SURFACE OF THE ROTOR BODY

CROSS REFERENCE TO RELATED APPLICATIONS

This application is based upon and claims benefit of priority to U.S. Provisional Application No. 62/525,252, filed Jun. 27, 2017 and hereby incorporated by reference.

FIELD OF THE INVENTION

This invention concerns rotors for compressors, pumps and rotary engines.

BACKGROUND

Rotors for devices such as compressors, pumps and rotary engines are finished to precise dimensions and tight tolerances. Rotors are thus among the more expensive and time consuming components in the manufacture of such devices. Rotors are furthermore complex parts because they receive one or more reciprocating vanes in slots that pass through the rotor body. It is a challenge to manufacture rotors economically and rapidly by conventional machining techniques, especially if it is desired that the rotor be formed from a single piece of metal. There is thus an opportunity to improve the design of rotors to promote their more efficient and rapid manufacture.

SUMMARY

The invention concerns a rotor. In one example embodiment the rotor comprises a first hub having a first hub radius. A second hub is coaxially aligned with the first hub. The second hub has a second hub radius. A vane housing is positioned between the first and second hubs. The vane housing comprises a cylindrical body having a longitudinal axis coaxially aligned with the first and second hubs. A slot extends through a diameter of the body and along the longitudinal axis. A first portion of the slot, extending radially from the longitudinal axis over a distance greater than both the first hub radius and the second hub radius, has a first width. A second portion of the slot, extending radially from the first portion to an outer surface of the body, has a second width less than the first width. A third portion of the slot, extending radially from the longitudinal axis over a distance greater than both the first hub radius and the second hub radius, hays a third width. Afourth portion of the slot, extending radially from the third portion to the outer surface of the body has a fourth width less than the third width.

In a particular example embodiment the first hub radius is equal to the second hub radius. Further by way of example the first width is equal to the third width. Again by way of example the second width is equal to the fourth width.

An example embodiment further comprises a shaft extending from the second hub. The shaft is coaxially aligned with the first and second hubs. Another example embodiment comprises a vane slidably positioned within the slot. The vane may be mounted on an eccentric cam such that rotation of the rotor about the longitudinal axis causes reciprocal motion of the vane within the slot.

The invention also encompasses a method of manufacturing a rotor. In one example embodiment the method comprises:

integrally casting a first hub, a second hub and a vane housing between the first and second hubs, the first hub having a first hub radius, the second hub having a second hub radius, the vane housing comprising a cylindrical body having a longitudinal axis coaxially aligned with the first and second hubs;

using a mold core to cast a slot extending through a diameter of the body and along the longitudinal axis, a first portion of the slot, extending radially from the longitudinal axis over a distance greater than both the first hub radius and the second hub radius, having a first width, a second portion of the slot, extending radially from the first portion to an outer surface of the body having a second width less than the first width, a third portion of the slot, extending radially from the longitudinal axis over a distance greater than both the first hub radius and the second hub radius, having a third width, a fourth portion of the slot, extending radially from the third portion to the outer surface of the body having a fourth width less than the third width.

An example method according to the invention may further comprise integrally casting a shaft connected to the second hub. The shaft is coaxially aligned with the second hub. Further by way of example the method may comprise grinding the second and fourth slot portions to a desired final width. Another example method comprises grinding the second slot portion to a final width less than the first width. Another example method comprises grinding the fourth slot portion to a final width less than the third width. Additionally by way of example, the method may comprise turning the rotor to achieve final outer diameters of the first hub, the second hub, the shaft and the vane housing.

DETAILED DESCRIPTION

Figure 1:
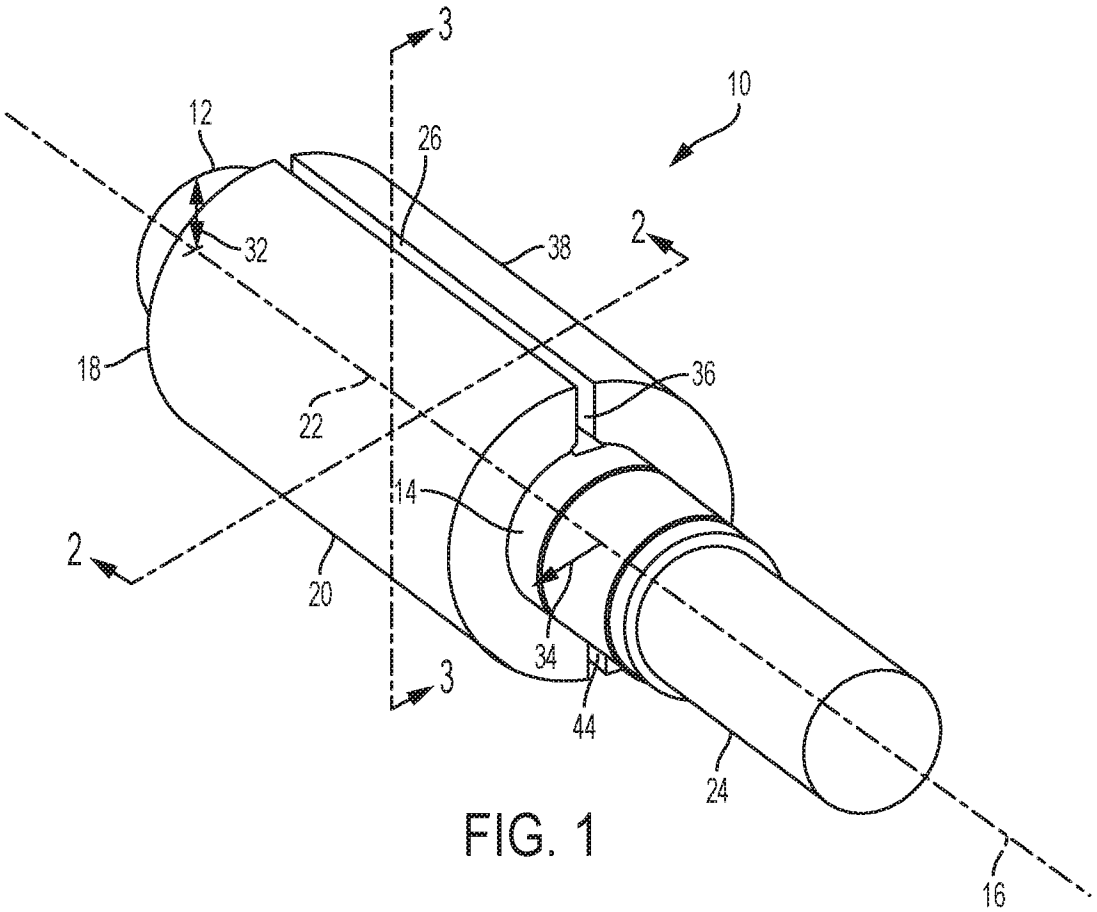
FIG. 1 shows an isometric view of an example rotor according to the invention.

FIG. 1 shows an example embodiment of a rotor 10 according to the invention. Rotor 10 comprises a first hub 12 and a second hub 14 coaxially aligned with one another along an axis of rotation 16. Hubs 12 and 14 may be received within bearings when the rotor is mounted within a device, such as a compressor, a pump, or a rotary engine (not shown). A vane housing 18 is positioned between the hubs 12 and 14. Vane housing 18 comprises a cylindrical body 20 having a longitudinal axis 22. Longitudinal axis 22 is coaxially aligned with the axis of rotation 16 of hubs 12 and 14. A shaft 24 extends from the second hub 14. Shaft 24 is coaxially aligned with the hubs 12 and 14 and the body 20.

Figure 2:
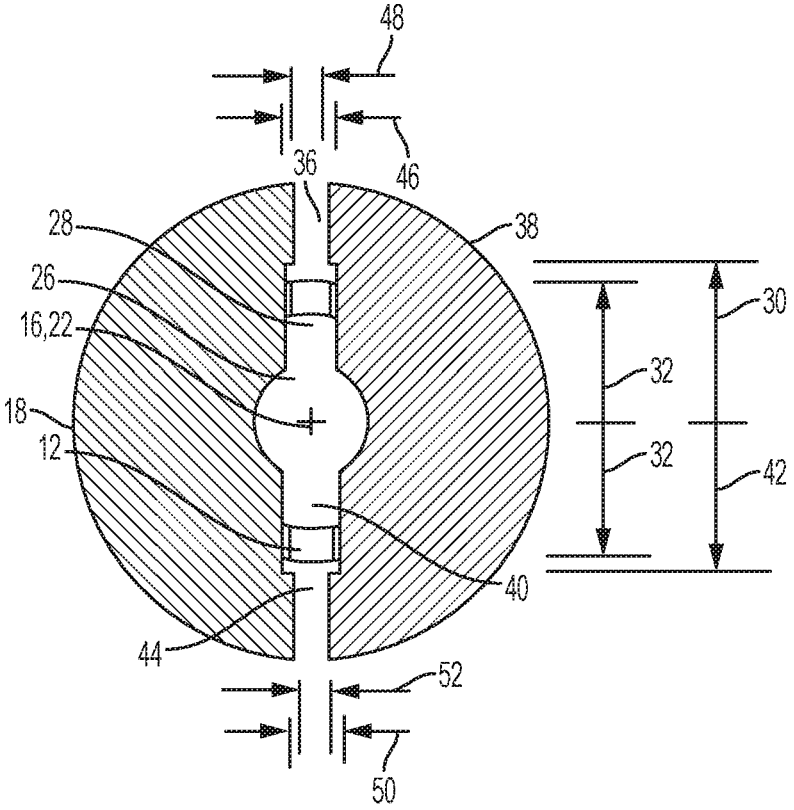
FIG. 2 is a cross sectional view taken at line 2-2 of FIG. 1.
Figure 3:
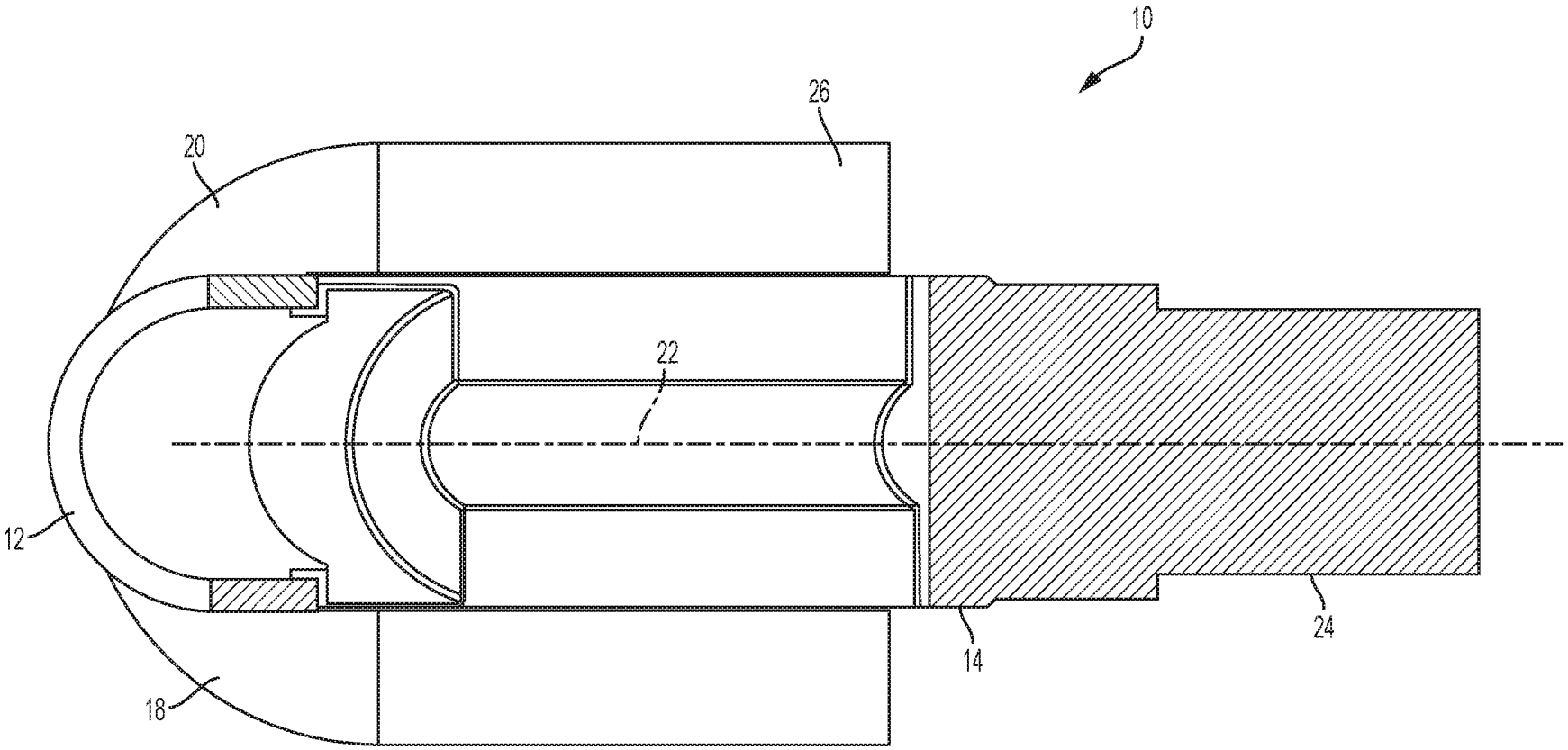
FIG. 3 is a longitudinal sectional view taken at line 3-3 of FIG. 1.

As shown in FIGS. 1 and 2, a slot 26 extends through a diameter of the body 20. As shown in FIGS. 1 and 3, slot 26 also extends lengthwise along the body's longitudinal axis 22. Slot 26 is formed of four portions. As shown in FIGS. 1 and 2, a first portion 28 of the slot 26 extends radially from axis 22 over a distance 30 greater than both the first and second hub radii 32 and 34, the hub radii being measured from the axis of rotation 16. A second portion 36 of slot 26 extends radially from the first portion 28 to the outer surface 38 of the body 20. A third portion 40 of the slot 26 extends radially from axis 22 over a distance 42 greater than both the first and second hub radii 32 and 34. A fourth portion 44 of slot 26 extends radially from the third portion 40 to the outer surface 38 of the body 20. The third and fourth slot portions 40 and 44 are diametrically opposite to the first and second slot portions 28 and 36. The first and third slot portions 28 and 36 extend respectively over the distances 30 and 42 which are greater than the radii 32 and 34 of the hubs 12 and 14 because this geometrical relationship allows the second and fourth slot portions 36 and 44 to be ground to a desired width using a grinding wheel without affecting the hubs as described below. Absent the separation between the second and fourth slot portions 36 and 34 and the hubs 12 and 14 a grinding wheel passing through the slot would also grind a channel through the hubs. Such a channel is to be avoided because it forms a leak path between high and low pressure areas of the device in which the rotor is used. For practical designs, as shown in the example rotor 10, the hub radii 32 and 34 may be equal to one another.

The slot portions are distinguished from one another by their respective widths. First portion 28 of slot 26 has a first width 46, and second portion 36 has a second width 48 less than width 46. Third portion 40 of slot 26 has a third width 50, and fourth portion 44 has a fourth width 52 less than the third width 50. For practical designs, as shown in the example rotor 10, the first width 46 is equal to the third width 50 and the second width 48 is equal to the fourth width 52.

Figure 4:
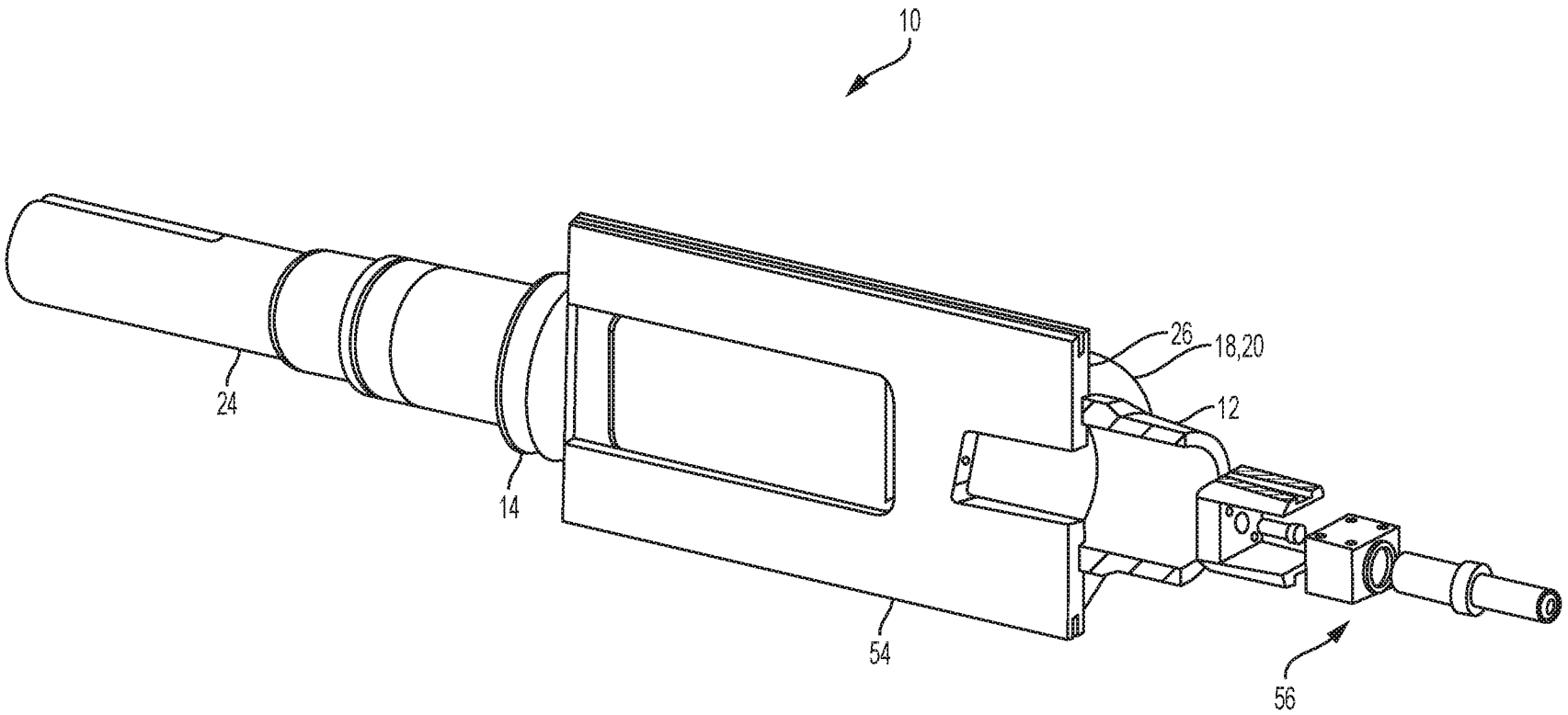
FIG. 4 is a partial sectional view showing an example rotor assembly according to the invention.

It is advantageous to control the second and fourth widths 48, 52 of slot 26 to precise dimensions and tight tolerances because these portions of the slot serve as guides for a vane 54 (see FIG. 4) which reciprocates within the slot 26 during operation of the rotor in a device. Vane 54 is mounted on an eccentric cam arrangement 56 which causes the vane to undergo reciprocal sliding motion when the rotor rotates about axis 22.

Figure 5:
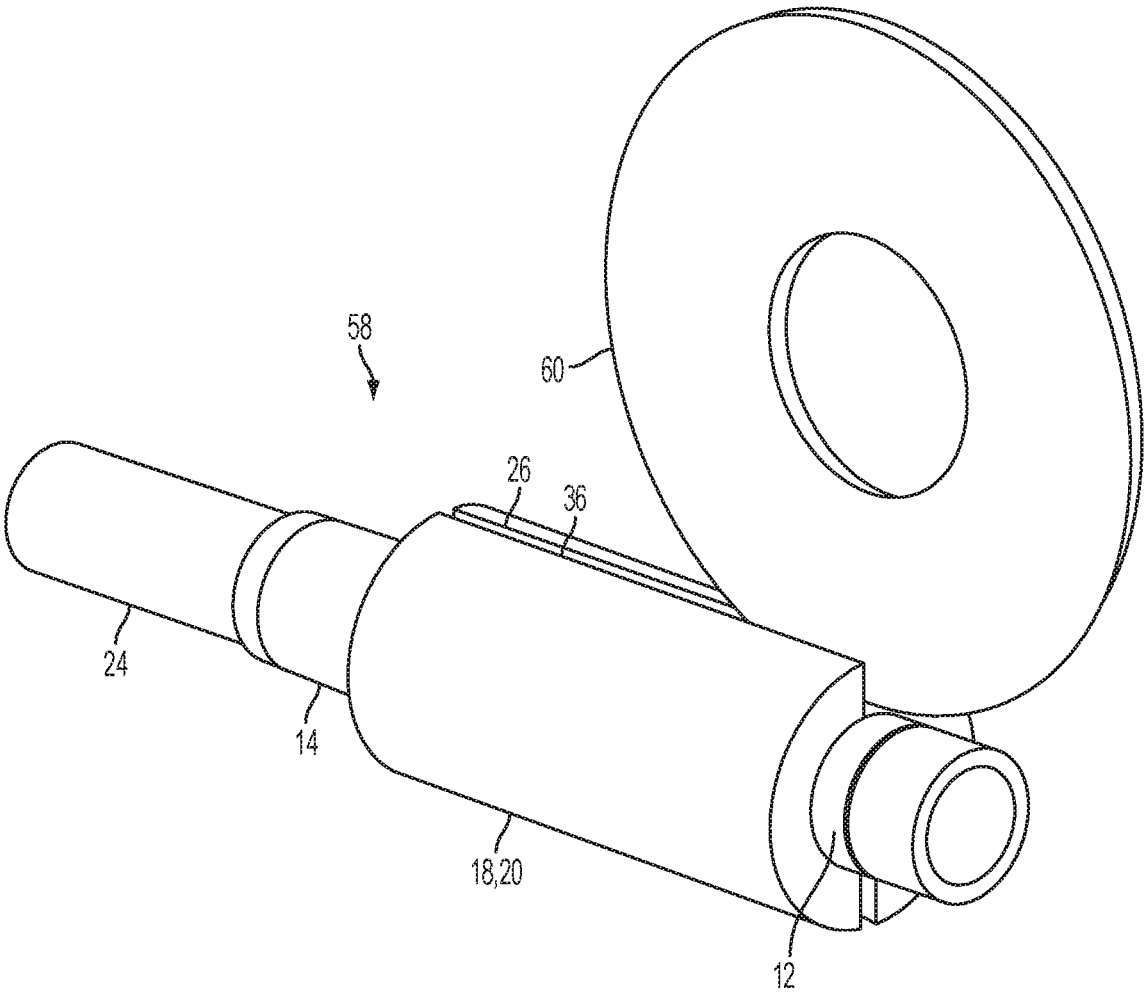
FIG. 5 is an isometric view showing a step in an example manufacturing process of an example rotor according to the invention.

Rotor 10 is advantageously manufactured by integrally casting the hubs 12 and 14 with the body 20 and the shaft 24 in a cavity and core mold (not shown). A void space is created within the body 20 using a core which is shaped to the rough dimensions of the slot 26 including its four portions 28, 36, 40 and 44. Once free of the mold and core, as shown in FIG. 5, the rotor casting 58 is subjected to turning and grinding operations. Shown is the use of a grinding wheel 60 which is run through the second and fourth slot portions 36 and 44 (36 shown) to establish the desired final width of these slot portions. Grinding is advantageous because it provides the needed precision and accuracy and is a faster and less expensive operation than other techniques, such as plasma cutting. The wheel 60 is able to finish the slot portions 36 and 44 to the desired final width without adversely affecting the hubs 12 and 14 because the first and third portions of the slot 26 extend outwardly beyond the radii of the hubs.

What is claimed is:

1. A rotor, comprising:

a first hub having a first hub radius;

a second hub coaxially aligned with said first hub, said second hub having a second hub radius;

a vane housing positioned between said first and second hubs, said vane housing comprising:

a cylindrical body having a longitudinal axis coaxially aligned with said first and second hubs, a slot extending through a diameter of said cylindrical body and along said longitudinal axis, a first portion of said slot, extending radially from said longitudinal axis over a distance greater than both said first hub radius and said second hub radius, having a first width, a second portion of said slot, extending radially from said first portion to an outer surface of said cylindrical body, having a second width less than said first width, a third portion of said slot, extending radially from said longitudinal axis over a distance greater than both said first hub radius and said second hub radius, having a third width, a fourth portion of said slot, extending radially from said third portion to said outer surface of said cylindrical body having a fourth width less than said third width.

2. The rotor according to claim 1, wherein said first hub radius is equal to said second hub radius.

3. The rotor according to claim 1, wherein said first width is equal to said third width.

4. The rotor according to claim 1, wherein said second width is equal to said fourth width.

5. The rotor according to claim 1, further comprising a shaft extending from said second hub, said shaft being coaxially aligned with said first and second hubs.

6. The rotor according to claim 1, further comprising a vane slidably positioned within said slot.

7. The rotor according to claim 6, wherein said vane is mounted on an eccentric cam such that rotation of said rotor about said longitudinal axis causes reciprocal motion of said vane within said slot.

8. A method of manufacturing a rotor, said method comprising:

integrally casting a first hub, a second hub and a vane housing between said first and second hubs, said first hub having a first hub radius, said second hub having a second hub radius, said vane housing comprising a cylindrical body having a longitudinal axis coaxially aligned with said first and second hubs;

using a mold core to cast a slot extending through a diameter of said cylindrical body and along said longitudinal axis, a first portion of said slot, extending radially from said longitudinal axis over a distance greater than both said first hub radius and said second hub radius, having a first width, a second portion of said slot, extending radially from said first portion to an outer surface of said cylindrical body having a second width less than said first width, a third portion of said slot, extending radially from said longitudinal axis over a distance greater than both said first hub radius and said second hub radius, having a third width, a fourth portion of said slot, extending radially from said third portion to said outer surface of said cylindrical body having a fourth width less than said third width.

9. The method according to claim 8, further comprising integrally casting a shaft connected to said second hub, said shaft being coaxially aligned with said second hub.

10. The method according to claim 9, further comprising turning said rotor to achieve final outer diameters of said first hub, said second hub, said shaft and said vane housing.

11. The method according to claim 8, further comprising grinding said second portion and said fourth portion of said slot to a final width.

12. The method according to claim 11, comprising grinding said second portion of said slot to said final width less than said first width.

13. The method according to claim 11, further comprising grinding said fourth portion of said slot to said final width less than said third width.

* * * * *